United States Patent [19]

Morrison

[11] Patent Number: 4,556,339

[45] Date of Patent: Dec. 3, 1985

[54] ROTARY TROWEL BLADE ASSEMBLY

[76] Inventor: Donald R. Morrison, 6228 Eagle Peak Dr., Charlotte, N.C. 28214

[21] Appl. No.: 669,027

[22] Filed: Nov. 7, 1984

[51] Int. Cl.[4] ..... E01C 19/22

[52] U.S. Cl. ..... 404/112; 51/177; 15/235.4

[58] Field of Search ..... 404/112; 51/177; 425/458; 15/235.3, 235.4, 235.5, 235.6, 235.7, 235.8; 403/154, 155, 318, 379, 398, 399, DIG. 4

[56] References Cited

U.S. PATENT DOCUMENTS

| | | | |
|---|---|---|---|
| 470,507 | 3/1892 | Risser | 403/154 X |
| 1,220,986 | 3/1917 | Henderson | 15/235.5 |
| 2,048,529 | 7/1936 | Williams | 15/235.5 |
| 2,667,824 | 2/1954 | McCrery | 404/112 |
| 3,289,521 | 12/1966 | Van Sloun | 403/318 |
| 3,296,946 | 1/1967 | Cagno | 404/112 |
| 3,375,766 | 4/1968 | Zochil | 404/112 |
| 3,675,544 | 7/1972 | Zochil | 404/112 |
| 4,236,439 | 12/1980 | Imai | 403/379 |
| 4,443,144 | 4/1984 | Defrancq | 403/155 X |

*Primary Examiner*—James A. Leppink
*Assistant Examiner*—John F. Letchford
*Attorney, Agent, or Firm*—B. B. Olive

[57] ABSTRACT

A trowel blade assembly attaches to the drive arm of a concrete troweling machine by means of a mounting bar which is bolted to the drive arm. The mounting bar in turn is received by a U-shaped bracket which is bolted to the trowel blade and incorporates recesses formed so as to cover the threaded connections between the blade and the bracket to permit easy removal. A quick release fastener passes through mating holes formed in the bracket and the bar enabling rapid repositioning or replacement of the blade-bracket assembly when one or both of the working edges of the blade are worn.

4 Claims, 7 Drawing Figures

ROTARY TROWEL BLADE ASSEMBLY

DESCRIPTION

1. Technical Field

The invention relates to powered rotary trowels for troweling concrete. More specifically, the invention relates to the trowel blades and means for mounting and replacing the blades.

2. Background Art

Trowel blades used on powered rotary trowels mount on drive arms and rotate while held in a tilted position and work the concrete with only one edge. The working edges of the metal blades wear quickly. Therefore, there is a constant need for being able to quickly reposition the blades to allow a different edge to become the working edge and also to be able to quickly replace blades which have become worn on both edges. Because of the tremendous volume of blades which are used and worn out in service, there is also a critical need to minimize the number of metal blade mounting parts associated with the worn blades which have to be scrapped with the worn blades.

In some powered trowel systems, the trowel drive arms are detachably secured to a metal tube or U-shaped bracket which in turn is typically welded or riveted to the blade. U.S. Pat. No. 3,259,033 illustrates a type of blade mounting arrangement in which the trowel drive arm is detachably connected to a tube which in turn in riveted to the blade. U.S. Pat. No. 2,878,730 illustrates a trowel drive arm secured to a U-shaped bracket by bolts and with the U-shaped bracket itself welded to the trowel blade. It still another type of construction the trowel blade drive arm is bolted to a bar which is in turn welded or riveted to the trowel blade. U.S. Pat. No. 3,791,754 illustrates a powered trowel drive arm secured by bolts to a bar which is in turn welded to the trowel blade. In the type of powered trowel on which a bar is secured to the trowel drive arm the bar sometimes serves as a means both for mounting the trowel blade and also as a means for effectively extending the length of the drive arm.

In any powered trowel in which a metal bar, a channel, a U-shaped bracket or the like is riveted or welded to the blade as part of the trowel blade mounting arrangement, there is inherently a considerable waste of metal by reason of the fact that the metal bar, tube, U-shaped bracket or the like which is welded or riveted to the blade must be discarded when the blade is discarded since it is not economical to separate the same. Thus, it would be desirable to provide a trowel blade mounting apparatus in which the blade only could be discarded when worn out so as to minimize the amount of metal that is wasted.

Powered trowel apparatus is subject to extremely rough working conditions and wet concrete frequently finds its way into any type of bolt or threaded connection thus making any type of blade replacement requiring unfastening of a threaded connection extremely difficult. Various attempts have been made to provide a means for enabling the trowel blades to by quickly repositioned when one edge is worn or replaced when both edges are worn. For example, U.S. Pat. No. 2,983,203 teaches a type of spring-loaded latch pin for attaching and releasing the blade from the trowel drive mechanism. The previously-mentioned U.S. Pat. No. 3,259,033 also allows the blade to be repositioned or to be replaced by removing a pin in turn secured by a cotter pin. U.S. Pat. No. 2,888,863 illustrates another type of connection using a threaded wing nut and bolt for securing the trowel blade to the trowel drive mechanism. U.S. Pat. No. 3,296,946 illustrates the blade secured to the drive arm by means taking advantage of centrifugal force to maintain the drive arm-blade connection. U.S. Pat. No. 3,675,544 teaches a type of threaded connection for facilitating the coupling and uncoupling of the trowel blade from the trowel drive mechanism. U.S. Pat. No. 2,662,454 illustrates another type of powered concrete trowel in which one type of trowel blade is latched and loosely supported on another type of trowel blade secured to the trowel drive arm and with the securement of the two blades dependent on the drive direction for maintaining the two blades connected together.

While other types of trowel blade mounting configurations might be mentioned, it is believed that the foregoing description is sufficient to indicate the disadvantage of those types of trowel blade mounting arrangements in which a metal bar, a tube, a U-shaped bracket or the like is welded, riveted, or otherwise permanently secured to the trowel blade such that when a trowel blade is discarded there must also be discarded substantial additional metal attached to the blade. Thus far, there has been no available trowel blade mounting arangement to avoid this kind of waste.

The foregoing description is also believed to be adequate to make clear that any type of threaded connection which must be loosened and tightened in order to remove or install a trowel blade is subject to the disadvantage of being locked by wet concrete falling on the connection and then hardening due to the severe working conditions of powered trowel apparatus.

The foregoing description is also believed to be adequate to point out the need for not only eliminating the mentioned waste of metal but also to provide a trowel blade mounting arrangement adapted for use with a quick release pin or other type of non-threaded connection not likely to be damaged or made inoperable by wet concrete which hardens around the fastening connection.

Additionally, the foregoing description is also believed to be adequate to point out the advantage of a blade mounting construction which will allow the blade to be bolted and removably secured to a U-shaped channel and with means to protect the bolt connections securing the trowel to the U-shaped channel so as to avoid contamination with wet concrete which later hardens and makes separation of the bracket or tube from the blade difficult.

Thus, it becomes the object of the present invention to provide a trowel blade mounting apparatus which effectively extends the drive arm, enables the blade only to be discarded when worn out, allows the blade to be bolted to its mount by protected threaded connections and also provides a pin-type quick connect-disconnect securement. These and other objects will become apparent as the description proceeds.

DISCLOSURE OF THE INVENTION

The invention apparatus is directed to an improved trowel blade mounting assembly aimed at minimizing the number of trowel parts which have to be discarded when the trowel blades are worn and replaced. Additionally, the invention apparatus allows the blade to be bolted to a mounting bracket but in a manner whereby a mounting bar received by the bracket itself protects the threaded connections between the blade and bracket so as to avoid spillage of concrete on the threaded connections during service thereby allowing the blade and the bracket to be quickly disconnected when desired.

Each drive arm is bolted at one end to a bar which extends the length of the drive arm. The opposite end of the drive arm mounts in the trowel drive. A U-shaped bracket which extends for substantially the length of the blade is bolted to the blade by bolts with countersunk heads on the bottom of the blades to retain a smooth surface on the bottom of the blade. Recesses are provided in the mentioned bar which cover the nuts used to secure the blades to the U-shaped bracket thereby preventing contamination with loose concrete during service. The bar is detachably connected to the U-shaped bracket by means of a quick disconnect pin. Thus, by removing a single quick disconnect pin the blade can be either repositioned or replaced as required and when worn out the blade can be easily separated from the bracket to minimize loss of metal.

BEST MODE FOR CARRYING OUT THE INVENTION

Figure 7:
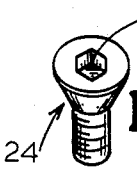
FIG. 7 is a perspective view of the type bolt employed to secure the blade to the bracket.

Making reference to the drawings, there is illustrated a U-shaped bracket 10 having a flat base 11 and opposed flat sides 12, 14 extending for a major portion of the length of the trowel blade 15. Trowel blade 15 may be of any conventional construction and is formed with three lengthwise aligned, spaced apart, bolt holes 16, 18, 20 along its long central axis. Holes 16, 18, 20 are formed with countersunk surfaces on the bottom working face of blade 15 to receive mating flathead, countersunk bolts 24, 26, 28 each with an Allen head recess 30 as seen in FIG. 7.

Bolts 24, 26, 28 pass through holes 16, 18, 20 of blade 15 and through corresponding holes 32, 34, 36 formed along the long central axis of the base 11 of bracket 10. Bolts 24, 26, 28 receive nuts 40, 42, 44 which when tightened secure bracket 10 to blade 15. While three bolts are illustrated a greater or less number may be employed to suit particular powered trowel configurations. Bracket 10 is centrally located on the top surface of blade 15 and as previously mentioned extends for a major portion of the length of blade 15 essentially parallel to the working edges 15', 15'' of blade 15.

Bracket 10 receives a mounting bar 50 of substantially the same length and which on its flat bottom surface 52 has three recessed holes 54, 56, 58. Such number of holes will of course vary with the number of bolts used to secure blade 15 to bracket 10. Top flat surface 50' of bar 50 is secured to bottom flat face 60' on the blade mounting end of trowel machine drive arm 60 by means of three bolts 62, 64, 66 which pass through holes **60*a*, 60*b*, and 60*c* in arm 60 and are secured in holes 50*a*, 50*b* and 50*c*. It will of course be understood that the typical powered concrete trowel machine may have three, four or more drive arms. Only one arm 60** and one invention blade assembly is shown by way of example.

Figure 1:
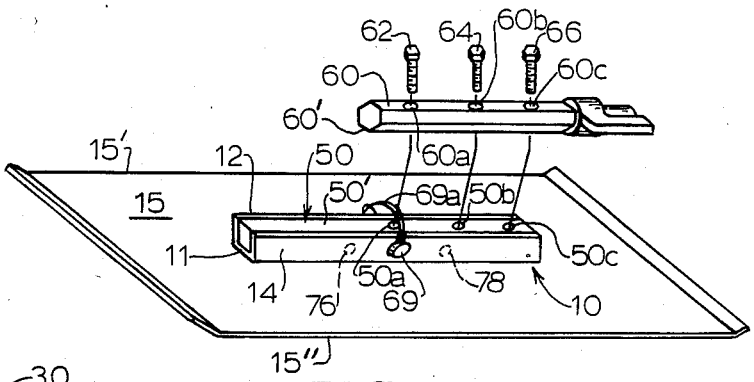
FIG. 1 is an exploded view of a powered trowel drive arm shown with the improved trowel blade assembly of the invention.
Figure 2:
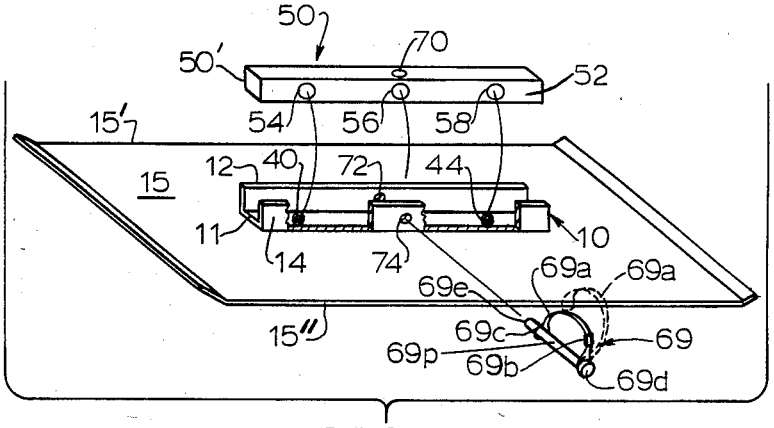
FIG. 2 is an exploded view illustrating a U-shaped bracket removably secured to the trowel blade, a bottom view of the mounting bar and the quick disconnect pin used to assemble the mounting bar to the bracket and blade assembly.
Figure 4:
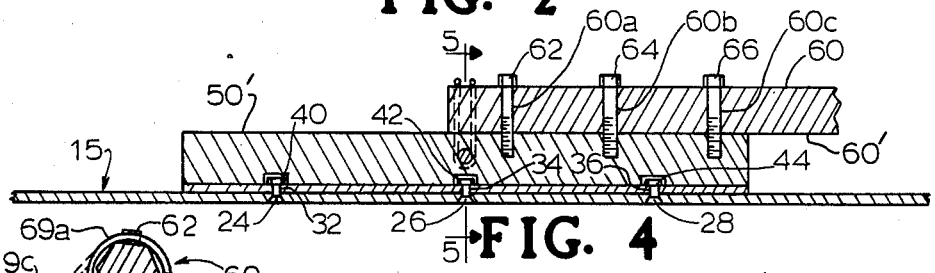
FIG. 4 is a partial section view illustrating the trowel drive arm assembled to the mounting bar bracket and blade.

Bracket 10 is formed with one or more pairs of opposed pin receiving holes in bracket sides 12, 14 to receive a quick disconnect pin 69 which also passes through a mating pin receiving hole 70 extending from side to side through bar 50. In FIG. 2, pin receiving bracket holes 72, 74 are shown located essentially midway of the length of bracket 10. However, as further indicated by dotted line positions 76, 78 in FIG. 1, the bracket pin mounting holes may be located off center to accommodate to the specific trowel configuration.

Pin fastener 69 is of the type having a relatively strong resilient latch **69*a* formed of bent wire secured by a grasp 69*b* and having a formed wire loop portion 69*c* for retaining the latch member 69*a* in a locked position on pin 69*p* at its outer end 69*c*. Latch 69*a* pivots on head 69*d* of pin 69*p***. While other types of quick disconnect pins could be used, the particular described type of quick disconnect pin has been found especially suitable and rugged and one such spring-type pin is made by Bee Industries, Inc., of Watertown, Wis. In selecting a quick disconnect pin or other equivalent quick disconnect device, it is important to avoid any type of threaded connection which may become contaminated by wet concrete and therefore be difficult to remove when required. Additionally, the particular quick disconnect device chosen should be one that can accommodate to extremely severe service of the kind encountered in typical concrete troweling operations.

Figure 5:
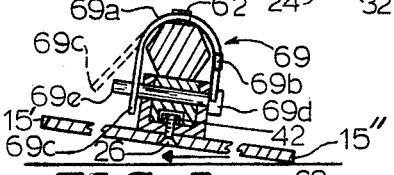
FIGS. 5 and 6 represent partial cross-sectional views taken generally in the direction of line 5—5 of FIG. 4 illustrating how the blade assembly is tilted in one direction or the other during service thus placing wear primarily on one or the other of the working edges.
Figure 6:
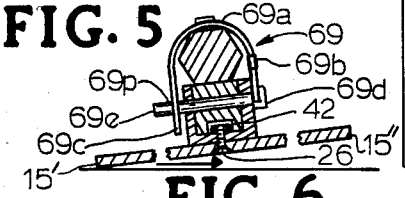
Figure 3:
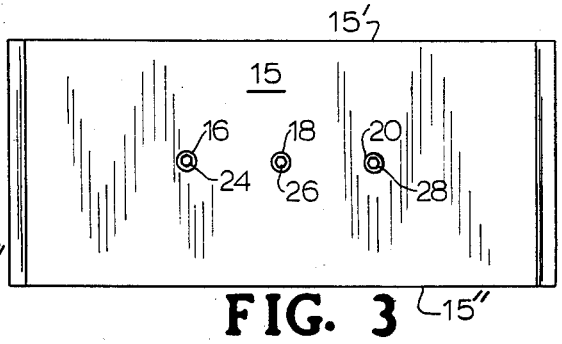
FIG. 3 is a bottom view of the trowel blade illustrating the countersunk holes for receiving the bolts which attach the blade to the U-shaped bracket.

Once mounting arm 50 has been secured to drive arm 60 of the trowel machine, it will be seen that the blade assembly consisting of blade 15 and bracket 10 secured by mentioned bolts 42, 44, and 46 to blade 15 are readily connected together by proper mating of mounting hole 70 with bracket holes 72, 74 or other paired sets of bracket holes which are employed and insertion of the quick disconnect pin fastener 69. Pin fastener 69 is installed with its latch member **69*a* pivoted upwardly (FIG. 2) for installation followed by locating locking loop portion 69*c* over end 69*d* of the pin. Once so secured together, trowel blade 15 is tilted in one direction or the other corresponding to the drive arm direction so as to impose wear on either edge 15' or edge 15'' as in FIGS. 5 and 6. Thus, assuming that only one edge has become worn, the invention apparatus allows the blade 15 to be quickly reversed for imposing wear on the opposite edge simply by removing quick disconnect pin fastener 69, reversing blade 15 and reinstalling quick disconnect pin fastener 69. Further, after both working edges 15', 15'' of blade 15 have been worn to the extent that blade 15 has to be discarded, the invention assembly allows the blade assembly consisting of blade 15 and bracket 10 to be removed for replacement by a similar preassembled blade-bracket bracket assembly with bracket 10 already secured to blade 15. This worn blade-bracket assembly consisting of a worn blade 15 and bracket 10 may then go to a separate station where nuts 40, 42 and 44 can be quickly removed such that the same bracket 10 can be reinstalled on a new blade 15. Alternatively, new blades 15 can be quickly installed at the site on the old brackets 10. Since all of the mentioned parts are made of metal at considerable expense, it will be seen that the invention assembly allows blade 15** only to be discarded when worn, thus accomplishing one of the major objectives of the invention.

It will also be noted that the flat sides and bottom surface of bar 50 reside in a substantially close fit within bracket 10 and because of this and also because of the previously mentioned recesses 54, 56 and 58 in bottom surface 52 of bar 50 covering respective nuts 40, 42 and 44, there is no opportunity for the wet concrete to work its way into and harden on the threaded connections of any of nuts 40, 42, or 44. Thus, removal of bracket 10 from blade 15 has proven to be extremely easy and can be quickly accomplished so as to save bracket 10 for use with another blade 15. Another advantage arises by reason of the fact that the mounting of recesses 54, 56 and 58 in bar 50 over respective nuts 40, 42 and 44 prevents bar 50 from shifting with respect to blade 15 by reason of the respective nuts residing in the respective recesses 54, 56 and 58. Thus, as centrifugal force is developed during operation of the improved blade assembly of the invention, the centrifugal force which would otherwise tend to separate bracket 10 from support arm 50 and blade 15 from bracket 10 is imposed both on quick disconnect pin fastener 69 as well as on each of nuts 40, 42 and 44 in their respective recesses 54, 56, and 58 in bar 50.

Overall, there is thus provided an extremely improved trowel blade assembly meeting all of the principal objects of the invention, namely, providing an extension of the drive arm, eliminating and minimizing waste metal, providing a single pin quick disconnect and protecting the threaded connections mounting the blades to the brackets.

What is claimed is:

1. Trowel blade apparatus for attachment to a concrete troweling machine, comprising:

(a) a solid drive arm of the type having a drive mounting end and a blade mounting end with a flat bottom mounting surface and a plurality of spaced apart bolt receiving holes passing through said blade mounting end;

(b) a trowel blade having:

(i) a flat rectangular body portion with flat bottom and top surfaces;

(ii) two parallel working edges on opposite sides of said body portion; and (iii) a plurality of spaced apart bolt holes aligned along the central long axis of said body portion and having countersunk entrances on the bottom surface thereof;

(c) an elongated integrally formed U-shaped bracket having:

(i) a flat base wall with flat bottom and top surfaces;

(ii) a pair of opposed flat side walls extending outwardly from said base wall;

(iii) a plurality of spaced apart bolt holes aligned along the central axis of and formed in said base wall mating said holes in said blade body portion; and (iv) at least one pair of opposing pin receiving holes formed in said side walls intermediate of the length thereof;

(d) a plurality of bolt assemblies corresponding in number to said plurality of bolt holes in said blade body portion and bracket base wall, comprising:

(i) a plurality of flathead, countersunk headed, threaded plate securing bolts, said bolts being mounted in said blade body portion and bracket base wall bolt holes with said countersunk heads mated to said countersunk bolt hole entrances on the bottom surface of said blade body portion such that the flat heads of the bolts tend to continue the flat bottom surface of said blade body portion; and (ii) a plurality of nuts secured to said plate securing bolts and residing on the upper surface of said base wall and securing said bracket flat base wall bottom surface to said blade flat top surface with the central axis of said bracket base wall aligned substantially parallel to the said working edges of said blade and located substantially midway therebetween;

(e) an elongated solid mounting bar adapted to snugly fit within said bracket and having:

(i) flat top, bottom and side surfaces;

(ii) a length substantially equal to the length of said bracket;

(iii) at least one pin receiving hole passing through said bar from side-to-side and adapted to be mated with an opposed pair of said pin receiving holes in said bracket side walls;

(iv) a plurality of recesses formed in said bottom surface of said bar located such that when said flat bottom surface of said mounting bar rests on the said top flat surface of said bracket base wall said recesses are adapted to receive and substantially cover said nuts and said nuts serve to limit lengthwise shifting of said bar relative to said bracket and blade; and (v) a plurality of spaced apart threaded holes located in one end portion and in the said top surface of said mounting bar and mating said bolt holes in said drive arm;

(f) a second plurality of bar securing bolts passing through said drive arm bolt receiving holes and threadably secured in said mounting bar threaded holes whereby to securely join the blade mounting end of said drive arm to one end of said mounting bar with the flat bottom surface of said drive arm facing the flat top surface of said mounting bar and the opposite end of said mounting bar extending outwardly from said drive arm as an extension thereof; and (g) a quick release fastener having:

(i) a pin fitted to and loosely mounted in and passing through said mated bracket and mounting bar pin receiving holes whereby to releasably secure said mounting bar in a snug fit to said bracket and thereby to said blade and to retain said mounting bar in a position to allow said bar bottom surface recesses to cover said nuts and the threaded connections between said nuts and said plate securing bolts; and (ii) means for releasably holding said pin in said pin receiving holes.

2. An apparatus as claimed in claim 1 wherein said quick release fastener is of the type having a wire formed resilient arcuate latch adapted when said pin is installed in said pin receiving holes to overlie said bar and arm and to resiliently engage one end of said pin to retain said pin in said pin receiving holes.

3. An apparatus as claimed in claim 1 wherein said bracket side walls include at least two pairs of said pin receiving holes adapted to receive said pin in either of said pair.

4. An apparatus as claimed in claim 1 wherein said bracket includes at least one pair of said opposing pin receiving holes located in a position substantially centrally of the length of said bracket.

* * * * *